US008001803B2

(12) United States Patent
Kanagaki

(10) Patent No.: US 8,001,803 B2
(45) Date of Patent: Aug. 23, 2011

(54) DIAPER BAG WITH HEATED AND COOLED COMPARTMENTS

(76) Inventor: Debra Barker Kanagaki, San Jose, CA (US)

( * ) Notice: Subject to any disclaimer, the term of this patent is extended or adjusted under 35 U.S.C. 154(b) by 595 days.

(21) Appl. No.: 12/215,979

(22) Filed: Jun. 30, 2008

(65) Prior Publication Data

US 2009/0320516 A1 Dec. 31, 2009

(51) Int. Cl.
*F25D 3/08* (2006.01)

(52) U.S. Cl. ..... 62/457.2; 62/457.5

(58) Field of Classification Search ..... 62/457.1, 62/457.2, 457.5, 457–459, 371, 372; 224/148.1, 224/148.4, 576; 220/592.2, 592.21
See application file for complete search history.

(56) References Cited

U.S. PATENT DOCUMENTS 4,334,601 A * 6/1982 Davis ..... 224/148.3
4,801,088 A * 1/1989 Baker ..... 239/152
5,285,718 A * 2/1994 Webster et al. ..... 99/290
5,587,055 A * 12/1996 Hartman et al. ..... 203/1
5,658,314 A * 8/1997 Scheffer et al. ..... 606/235
6,132,059 A * 10/2000 Leibowitz ..... 362/156
6,422,024 B1 * 7/2002 Foye ..... 62/3.2
6,490,995 B2 * 12/2002 Greene, Jr. ..... 119/496
7,246,915 B2 * 7/2007 Verona ..... 362/156
2003/0024960 A1 * 2/2003 Greenstein et al. ..... 224/153
2004/0036442 A1 * 2/2004 Wu ..... 320/107
2005/0090179 A1 * 4/2005 Carruth ..... 446/71
2005/0133558 A1 * 6/2005 Toombs ..... 224/576
2006/0118567 A1 * 6/2006 Linnebur ..... 221/45
2006/0157525 A1 * 7/2006 Furlong et al. ..... 224/601
2006/0283205 A1 * 12/2006 Carriere ..... 62/457.2
2007/0221693 A1 * 9/2007 Moore ..... 224/148.6
2007/0223895 A1 * 9/2007 Flemm ..... 392/441
2008/0083802 A1 * 4/2008 Reziniano ..... 224/576
2008/0277219 A1 * 11/2008 McCarthy ..... 190/109
2009/0057288 A1 * 3/2009 Chen ..... 219/211

* cited by examiner

*Primary Examiner* — Mohammad Ali
(74) *Attorney, Agent, or Firm* — Ronald C. Fish

(57) ABSTRACT

A diaper bag having a major compartment with pockets on the walls or bottom thereof for one or more of the following accessories needed either by the mother or baby for travel: wipes, diapers, spare clothes, Mom's ipod, cell phone, keys and/or wallet, a changing mat, snacks, formula, baby food, and having actively or passively heated and cooled insulated compartments for formula, baby food included on the inside or outside of the main compartment.

13 Claims, 2 Drawing Sheets

DIAPER BAG WITH HEATED AND COOLED COMPARTMENTS

FIELD OF USE AND BACKGROUND OF THE INVENTION

The invention pertains to the field of diaper bags.

Modern mothers have a need to take their babies with them while doing errands, travelling with the family etc. Babies need a number of things with them when they travel such as formula, diapers, wipes, food, spare clothes, toys, changing mats etc. Mothers have a need for other things such as cell phones and ipods to entertain them and the baby.

All the diaper bags of which the inventor is aware do not have specialized compartments for the various things a mother and a baby on-the-go need and they have no active or passive mechanisms to heat and cool formula, food, etc. Prior art diaper bags also do not have specialized compartments for diapers, wipes, changing mats, spare clothes, Mom's keys, wallet, ipod and cell phone. Accordingly, a need has arisen for a specialized diaper bag which can accommodate and keep organized all the things a baby and its mother need while travelling.

SUMMARY OF THE INVENTION

A diaper bag according to the teachings of the invention will have a major compartment with pockets on the walls or bottom thereof for one or more of the following accessories needed either by the mother or baby for travel: wipes, diapers, spare clothes, Mom's ipod, cell phone, keys and/or wallet, a changing mat, snacks, formula, baby food.

In typical embodiments, actively or passively heated and cooled insulated compartments for formula, baby food, etc. are included on the outside of the main compartment. In other embodiments, they can be on the inside.

In some embodiments, a zippered compartment on the outside of the bottom wall of the diaper bag is used to store a changing mat.

In one embodiment, a portable battery is included in a compartment for powering active heating and cooling apparatus to heat and cool the insulated compartments for formula, food, etc. In other embodiments, the heated and cooled insulated compartments are only connected to a 12 volt charging line which is adapted for plugging into a cigarette lighter of a car such that active heating and cooling can occur when the diaper bag is plugged into the cigarette lighter of a car or other vehicle or is in some other way coupled to the battery of the vehicle.

In some embodiments, the battery is coupled to a 12 volt charging line which is adapted for plugging into the cigarette lighter of a car.

In other embodiments, the compartments for cell phone and ipod are structured to receive the ipod or phone in charging cradles, and are connected to the portable battery and the 12 volt charging accessory cord which is adapted for plugging into a car cigarette lighter or for coupling in any other way to the battery of a vehicle.

DETAILED DESCRIPTION OF THE PREFERRED AND ALTERNATIVE EMBODIMENTS

Figure 1:
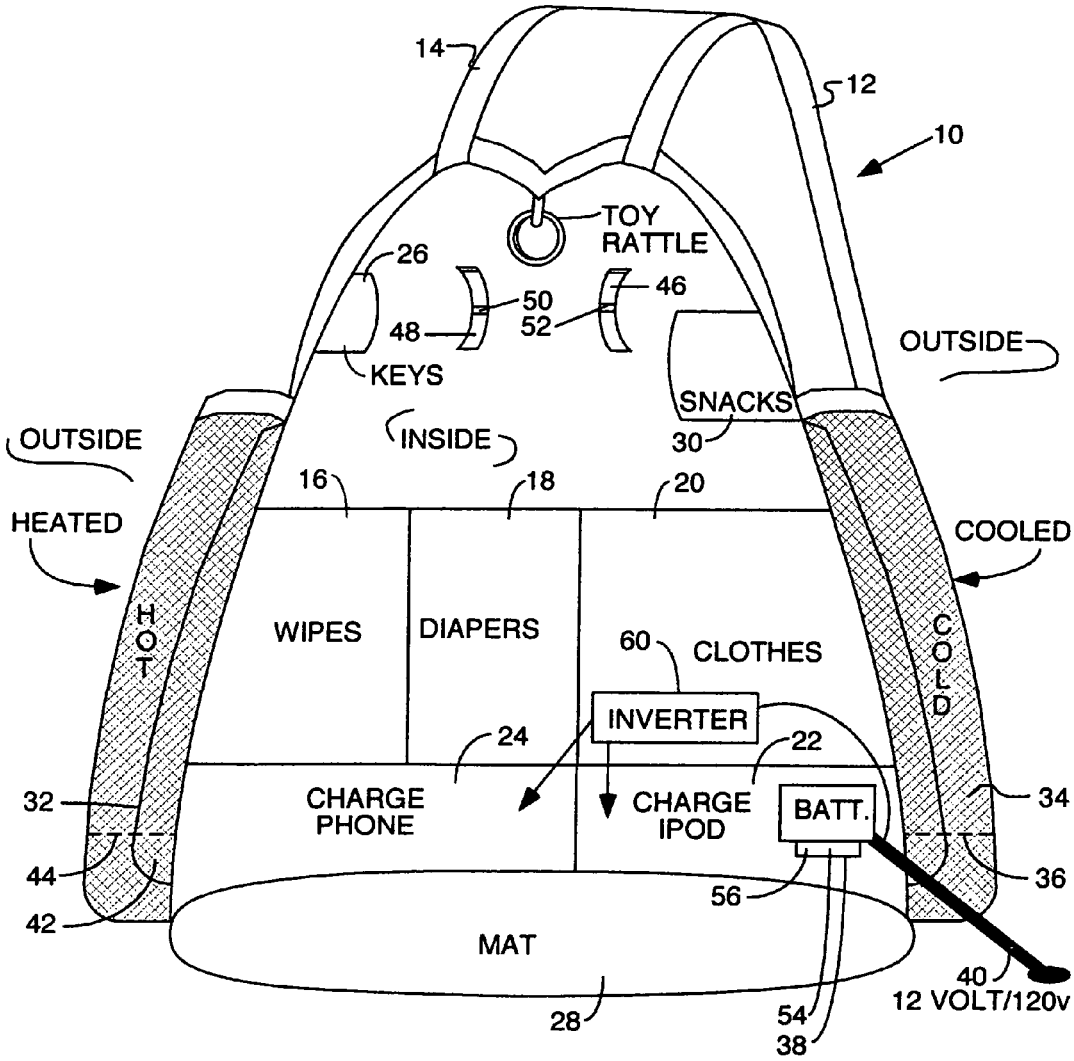
FIG. 1 is a schematic diagram of the backpack form of a diaper bag according to the invention.

Referring to FIG. 1, there is shown generally at 10 a diaper bag according to the teachings of the invention in back pack format with shoulder straps 12 and 14 which go over the shoulders of the wearer. The diaper bag will have a major compartment with pockets attached to the walls or bottom of the main compartment by sewing or any other means of mechanically affixing a pocket to a fabric or vinly main compartment wall or bottom. The pockets may be zippered, and are shown in outline form in FIG. 1 even though they are typically sewed to the inside walls of the main compartment of the diaper bag. These pockets can be affixed to the outside of the diaper bag walls or the inside of the diaper bag walls, and are typically used for one or more of the following accessories needed either by the mother or baby for travel: wipes 16, diapers 18, spare clothes 20, Mom's ipod 22, cell phone 24, keys 26 and/or wallet, a changing mat 28, snacks 30, formula 32 and baby food 34.

In typical embodiments, actively or passively heated and cooled, insulated compartments 32 and 34 are affixed to the outside walls of the diaper bag. These compartments are typically used to store formula, baby food, etc. In some embodiments, these heated and cooled compartments can be affixed to the inside walls of the diaper bag or some combination of the inside and outside walls. The cooling of the cooled compartment 34 can be passive by including a compartment inside the compartment in which dry ice or water ice can be stored. Preferably the separate compartment (symbolized by dashed line 36) inside compartment 34 is waterproof if water ice is to be used. The cooled compartment 34 is cooled by active semiconductor cooling components in other embodiments. These active cooling thermoelectric semiconductor components cool whatever is in contact with them when electrical current is passed through them. Such thermoelectric semiconductor components can be sewn into the walls of the cooled compartment 34 and are electrically coupled to a battery stored in battery compartment 38 and/or a 12 volt accessory charging cable 40 which is structured to couple the diaper bags electrical components to the battery of a vehicle, such as through a cigarette lighter.

Likewise, the heated compartment 32 can be heated passively or actively. Passive heating is done by storing a thermal mass which has been heated in a microwave or oven in a separate compartment (symbolized by dashed line 44) in the bottom of compartment 32. The thermal mass can be gel like is used in sports therapeutic equipment to cool or heat injury sites of athletes. A chilled thermal mass or gel can also be used in compartment 36 of cooled compartment 34.

In some embodiments, a zippered compartment 28 on the outside of the bottom wall of the diaper bag is used to store a changing mat. This compartment can also be closed by snaps, velcro etc. and may be located on one of the side walls of the diaper bag or across the top of the bag. The changing mat may also be stored as a roll without the use of any separate compartment for it such as by the use of straps 46 and 48 which fasten together at 50 and 52 by use of buckles, velcro, snaps, etc. These straps secured a rolled up changing mat to any one of the side walls or bottom of the diaper bag.

In one embodiment, a portable battery 54 is included in a battery compartment 54 for powering active heating and cooling apparatus to heat and cool the insulated compartments 32 and 34 for formula, food, etc. The portable batter may be a nickel-metal-hydride or nicad battery such as has been used for auxiliary power for cell phones in the prior art. Preferably, it is not a lead-acid battery although a sealed lead-acid batter could be used in some embodiments. In other embodiments, the heated and cooled insulated compartments are only connected to a 12 volt charging line 40 which is adapted for plugging into a cigarette lighter of a car such that active heating and cooling can occur only when the diaper bag is plugged into the cigarette lighter of a car or other vehicle or is in some other way coupled to the battery of the vehicle. In some embodiments, no portable battery is included in the diaper bag but a charging line 40 is used to couple active heating and cooling elements to external power and passive heating and cooling pockets 36 and 44 are included in which heating and cooling substances may be stored to carry the heating and cooling load when the diaper bag is not plugged into external power.

In the preferred embodiment, the compartments 24 and 22 for cell phone and ipod are structured to receive the ipod or phone in charging cradles. These charging cradles are connected to the portable battery and the 12 volt charging accessory cord which is adapted for plugging into a car cigarette lighter or for coupling in any other way to the battery of a vehicle.

Figure 2:
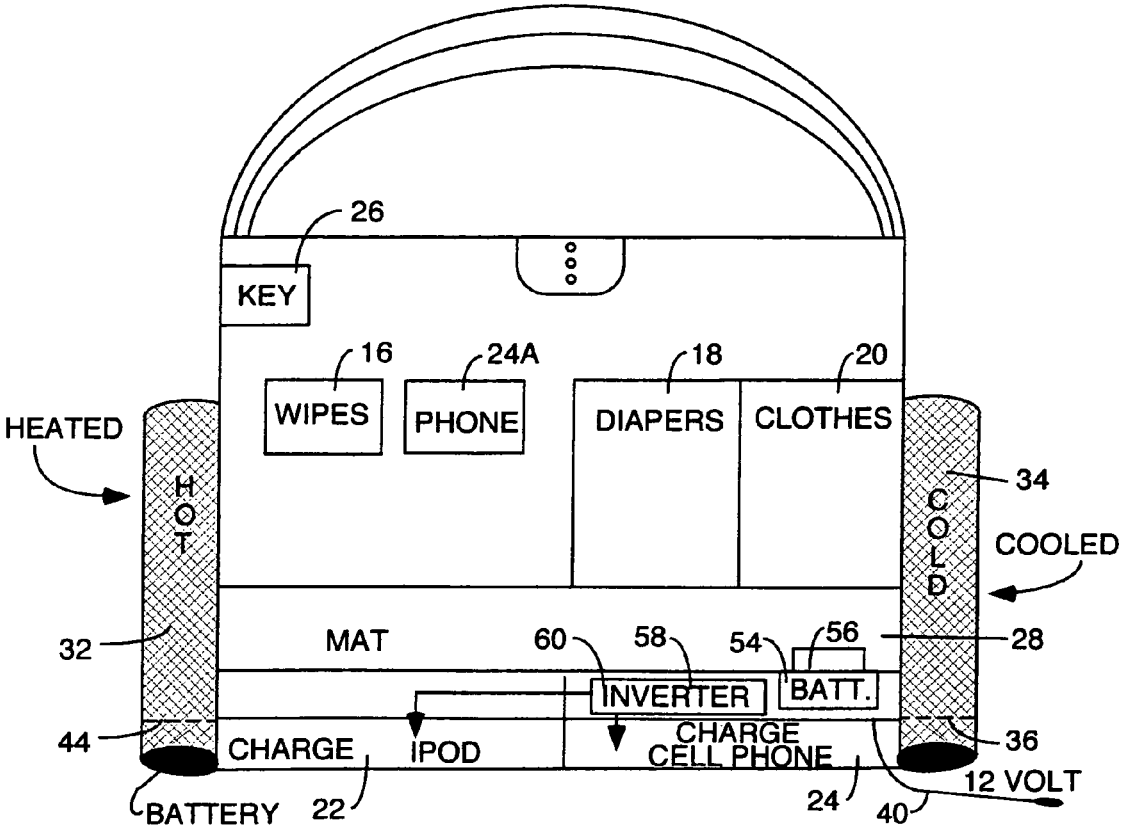
FIG. 2 is a schematic diagram of an traditional form of diaper bag with a handle.

FIG. 2 shows a conventional diaper bag configuration with a handle for carrying the diaper bag. Specialized pockets or storage areas for the various things a baby or Mom needs while travelling are included on the inside or outside walls of the diaper bag to enable Mom to keep things organized and separated. Pockets or storage areas having the same reference number as storage areas or pockets described with reference to FIG. 1 have the same structure, purpose and functionality as like numbered pockets in FIG. 1 and have the same alternative embodiments.

Both the FIG. 1 and FIG. 2 embodiments typically have a top closure such as a zippered or velcro fastened flap which closes off the main compartment and keeps the stuff inside the main compartment from falling out. Also, in the embodiments of FIGS. 1 and 2, the preferred embodiments within these classes of embodiments have charging circuitry 56 which is structured to charge the battery 54 from power supplied from an external source such as a vehicle battery or a 120 volt (or other wall power) supply. Also, in the embodiments of FIGS. 1 and 2, the preferred embodiments within these classes of embodiments have an inverter 60 which is coupled to the electrical conductor 40 for receiving 12 volt power and converting it to 120 volt power, this 120 volt power being adapted to couple to the cell phone charger 24 and the ipod charger 22 to supply power to these charging apparati for an ipod (or any other MP3 or other portable music player) and a cell phone. In this way, whatever type of cell phone or portable music player Mom has can be charged by using whatever charging circuitry operating from 120 volt power that came with the device.

Although the invention has been disclosed in terms of the preferred and alternative embodiments disclosed herein, those skilled in the art will appreciate possible alternative embodiments and other modifications to the teachings disclosed herein which do not depart from the spirit and scope of the invention. All such alternative embodiments and other modifications are intended to be included within the scope of the claims appended hereto.

What is claimed is:

1. A diaper bag apparatus having a main compartment and having an insulated passively cooled compartment and a passively heated compartment attached to either the inside or outside of said main compartment, and further comprising a changing mat compartment formed on the outside of said main compartment and attached to said main compartment, said changing mat compartment containing a rolled up changing mat which is attached at one end to the inside of the changing mat compartment and has sufficient length such that it can be rolled out when said diaper bag is placed down on the ground or other surface so as to provide a clean surface upon which a baby can be changed, said changing mat compartment having a flap or opening which can be closed by a zipper, snaps, velcro tabs or any other fastener so as to secure said changing mat inside said changing mat compartment after said changing mat has been rolled back up.

2. The diaper bag of claim 1 wherein said diaper bag further comprises a portable battery and a music player compartment for an IPOD(tm) or MP3 player, said music player compartment having a charging cradle therein coupled to said portable battery and adapted to charge said IPOD or MP3 player.

3. The diaper bag of claim 2 wherein said diaper bag's changing mat compartment is a a zippered compartment containing a rolled up cloth, plastic or nylon or any other synthetic fabric changing mat.

4. The diaper bag apparatus of claim 1 further comprising a portable battery and an active heating system in said passively heated compartment to provide supplemental heating, said active heating system comprising a heating element attached to a wall or floor of said passively heated compartment and coupled to said portable battery, said portable battery being located within said main compartment or attached to said diaper bag at any external location, and further comprising an active cooling system within said passively cooled compartment to provide supplemental cooling, said active cooling system comprising a thermoelectric semiconductor component attached to a wall or floor of said passively cooled compartment and coupled to said portable battery to receive power therefrom and chill whatever is in contact with said active cooling thermoelectric semiconductor component when electrical current is passed therethrough.

5. The diaper bag apparatus of claim 4 further comprising and a compartment for a cell phone having a charging cradle therein adapted to charge the type of cell phone a user of said diaper bag apparatus has, said charging cradle coupled to receive power from said portable battery, and further comprising one or more separate pockets or compartments for keys, wallet, snacks and spare clothes.

6. A diaper bag apparatus having a main compartment and having insulated passively or actively cooled and heated compartments, and further comprising a portable battery stored in a battery compartment and coupled to active heating elements in said heated compartment and active cooling elements in said cooled compartment.

7. The diaper bag of claim 6 wherein said insulated heated and cooled compartments have separate interior compartments therein for storage of thermal masses which can be heated or cooled before insertion into said interior compartments.

8. The diaper bag of claim 6 further comprising a charging cord comprising an electrically conductive cord with a sufficient number of conductors which is adapted for coupling to a vehicle battery or to a wall power supply, and further comprising charging means coupled to said charging cord and to said portable battery for charging said portable battery using power supplied from said vehicle battery or said wall power supply.

9. The diaper bag of claim 6 further comprising separate interior compartments in said insulated passively or actively cooled and/or heated compartments for storage of gel packs which can be heated or cooled before insertion into said interior compartments which function to carry the heating and cooling load when the battery has insufficient power to power said active heating and cooling elements.

10. The diaper bag of claim 6 further comprising a set of straps which can fasten around a changing pad which is rolled up into a roll to affix the roll to the outside of said diaper bag.

11. A diaper bag apparatus having a main compartment and having insulated passively or actively cooled and/or heated compartments, and further comprising one or more separate pockets or compartments for keys, wallet, ipod, cell phone, snacks, spare clothes and a changing mat affixed to inside or outside walls of a main compartment of said diaper bag, and further comprising a portable battery stored in a battery component and coupled to active heating elements in said heated compartment and active cooling elements in said cooled compartment, and further comprising a charging cord comprising an electrically conductive cord with a sufficient number of conductors which is adapted for coupling to a battery of a vehicle or to a wall power supply, and further comprising charging means for charging said battery from power supplied from said vehicle battery or a wall power supply, and further comprising separate interior compartments in said heated and cooled compartments for storage of thermal masses which can be heated or cooled before insertion into said interior compartments which function to carry the heating and cooling load when the battery has insufficient power to power said active heating and cooling elements.

12. The apparatus of claim 11 further comprising charging cradles for an ipod and a cell phone affixed to the walls of said diaper bag.

13. The apparatus of claim 11 further comprising charging cradles for an ipod and a cell phone affixed to the walls of said diaper bag and further comprising an inverter coupled to said charging cradles to supply 120 volt power to said charging cradles, said inverter also coupled to said charging cord to receive 12 volt power from an external source such as a vehicle battery.

* * * * *